United States Patent [19]

O'Brien

[11] Patent Number: 4,593,466

[45] Date of Patent: Jun. 10, 1986

[54] ELECTRIC KNIFE

[76] Inventor: William J. O'Brien, 45 Murray Street, Pyrmont, New South Wales, Australia

[21] Appl. No.: 667,111

[22] Filed: Oct. 30, 1984

[30] Foreign Application Priority Data

Nov. 10, 1983 [AU] Australia ..... PG2331

[51] Int. Cl.[4] ..... B26B 7/00

[52] U.S. Cl. ..... 30/272 A; 30/144; 30/296 R

[58] Field of Search ..... 30/272 R, 272 A, 298, 30/232, 144, 296 R

[56] References Cited

U.S. PATENT DOCUMENTS

| | | | |
|---|---|---|---|
| D. 203,819 | 2/1966 | Hall | 30/272 A |
| 1,481,055 | 1/1924 | Fullbright | 30/144 |
| 2,168,703 | 8/1939 | Dziedzic | 30/272 A |
| 3,337,954 | 8/1967 | Robison | 30/272 A |
| 3,376,640 | 4/1968 | Kramer | 30/272 R |
| 3,388,470 | 6/1968 | Ufer | 30/272 A |
| 3,399,456 | 9/1968 | Johnson | 30/232 |
| 3,555,678 | 1/1971 | Agulnick | 30/272 A |

FOREIGN PATENT DOCUMENTS

| | | | |
|---|---|---|---|
| 2040210 | 8/1980 | United Kingdom | 30/272 A |

*Primary Examiner*—Jimmy C. Peters

[57] ABSTRACT

An electric knife of the kind having an elongated handle that serves as a container for a driving electric motor, a pair of blades projecting in an axial direction from the handle, the blades being releasably secured to a drive connected to the motor in such a manner that the blades are reciprocated so as to move in sliding contact with each other the blades having serrated cutting edges, which is characterized by the feature that the line containing the serrated cutting edge of each of the blades is off set from the axis of the handle in such a manner that if the line is extended in the direction of the handle there is a space between the line and any adjacent portion of the handle.

3 Claims, 2 Drawing Figures

ELECTRIC KNIFE

The present invention relates to electric knives of the kind (hereinafter referred to as "the kind set forth") comprising an elongated handle that serves as a container for a driving electric motor, a pair of blades projecting in an axial direction from the handle, the blades being releasably secured to a driving means connected to the motor in such a manner that the blades are reciprocated so as to move in sliding contact with each other, the blades having serrated cutting edges.

An electric knife of the kind set forth is described in the specification of Australian Pat. No. 414,556. A variety of electric knives of the kind set forth are available in the market and all are constructed along essentially the same lines as the electric knife illustrated in the abovementioned specification.

A feature that characterises all electric knives known to the applicant is that the knife blades project directly away from the handle in a straight line, the handle being shaped in such a manner that a portion thereof projects beyond a line on which the serrated cutting edges of the blades lie.

It has now been discovered that a significant improvement in the effectiveness and usability of such electric knives can be achieved by connecting the blades to the handle in such a manner that the line containing the serrated cutting edge of each of the blades is offset from the axis of the handle in such a manner that if the line is extended in the direction of the handle there is a space between the line and any adjacent portion of the handle.

The present invention consists in an electric knife comprising an elongated handle that serves as a container for a driving motor, a pair of blades projecting in an axial direction from the handle, the blades being reasonably secured to a driving means connected to the motor in such a manner that the blades are reciprocated so as to move in sliding contact with each other, the blades having serrated cutting edges characterised in that the blades are constructed and arranged in relation to the handle in such a manner that the line containing the serrated cutting edge of each blade is offset from the axis of the handle in such a manner that if the line is extended in the direction of the handle there is a space between the line and any adjacent portion of the handle.

Figure 1:
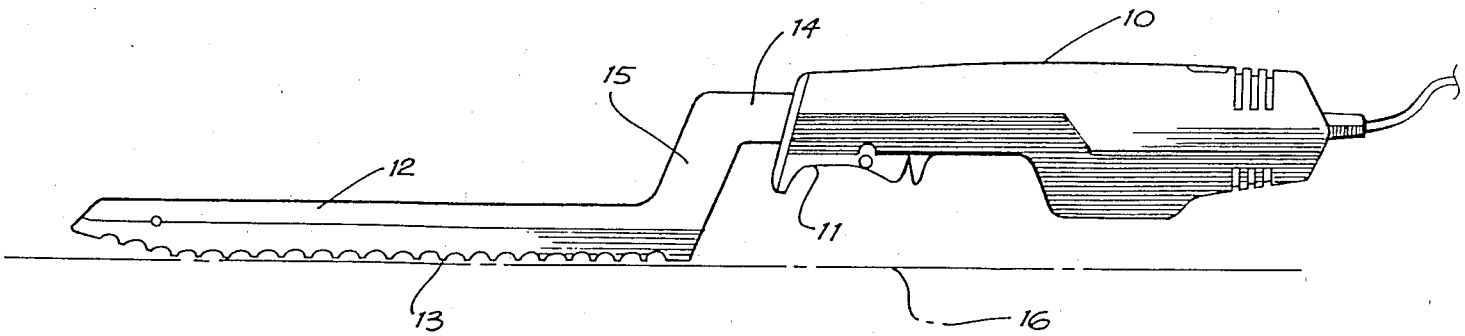
Figure 2:
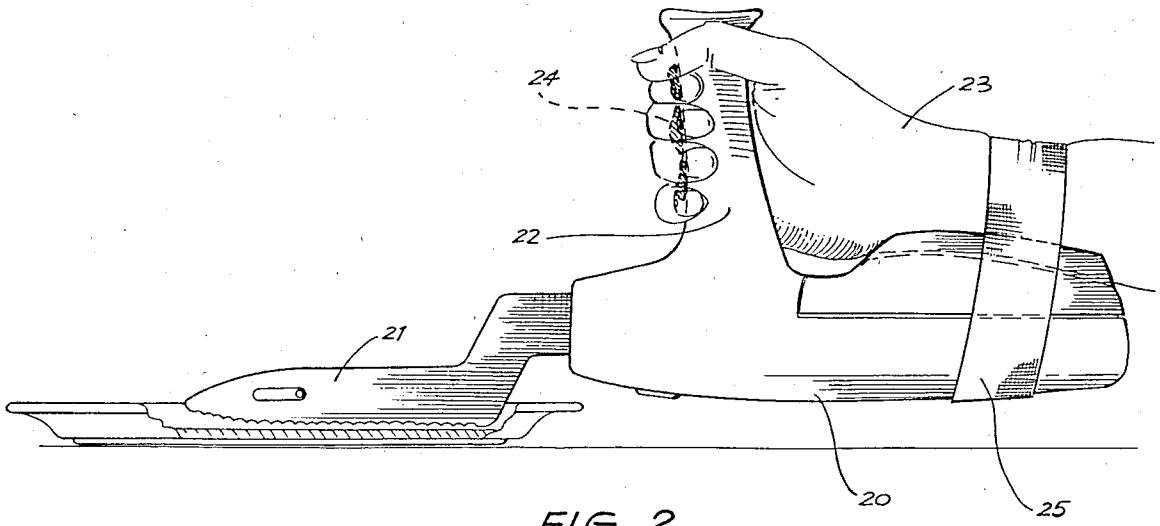

In order that the nature of the invention may be better understood a preferred forms thereof are hereinafter described by way of example with reference to the accompanying drawings in which:

FIG. 1 is a side elevation of a knife constructed according to the invention, and FIG. 2 is a side elevation of a second knife constructed according to the invention, intended particularly for use by the handicapped.

The knife depicted in FIG. 1 of the drawing consists of a handle 10 adapted to be held in the hand of a user and containing a driving electric motor controlled by operation of the trigger switch 11. A pair of knife blades 12 having serrated edges 13 are arranged side by side and are connected in a conventional manner to the driving motor so that the motor acts to reciprocate the knife side by side to effect a cutting action.

Whereas in the conventional electric knife the blades would constitute a straight extension of the portion 14 in a direction away from the handle 10, according to the present invention the blades 12 are offset by means of the portion 15 in such a manner that the line 16 containing the serrated edges of the blades, when extended in the direction of the handle, is spaced apart from any adjacent portion of the handle 10. Preferably the spacing is such that the handle can be grasped by the hand of a user whose knuckles will also be spaced from the line 16.

It has been found that an electric knife constructed in the manner described has significant advantages over a conventional electric knife in that in use the cutting edges of the knife blades can be more easily seen and the cut effected by the knife, more easily controlled.

Whereas the knife depicted in FIG. 1 of the accompanying drawing is intended for general use in slicing and cutting, a different form of electric knife is illustrated in FIG. 2 with a somewhat smaller handle 20 containing a very small battery operated electric motor and somewhat shorter blades that is intended for use by a handicapped person unable to wield an ordinary table knife.

The handle 20 is provided with an extension 22 projecting at right angles to the axis of the handle 20 and shaped to be gripped by the hand 23 of a user. The upper surface of the body 20 is shaped concavely in cross-section to accommodate the user's wrist. An electric on-off switch 24 is included in the extension 22 for operation by one or other of a user's fingers. The handle is furnished additionally with a wrist strap 25 the ends of which are preferably secured by means of VELCRO (Registered Trade Mark) fastening means, whereby the handle can be attached to the user's wrist in such a manner that major support for the knife is effected by the strap and that all the user has to do is to operate the trigger switch. Such an arrangement can be used to cut food on a plate in the manner illustrated. This would not be possible with an electric knife of ordinary configuration owing to the fact that plates are constructed with raised edges and it would not be possible to apply the cutting edges of the blades through the total thickness of food on the plate. Thus for such electric knives the invention provides an additional and special benefit.

The embodiments of the invention described above and illustrated in the drawing are given by way of example only as constituting forms of the invention within the general scope thereof as defined broadly in the succeeding claims.

I claim:

1. An electric knife, comprising:

an elongated handle housing a driving motor, a pair of blades projecting in an axial direction, from a forward end of said handle and being coupled to said driving motor for reciprocable motion relative to one another, each blade including a first straight portion supported in said handle one end, a second straight portion disposed forwardly of said first portion, and a third portion interconnecting the forward end of said first portion with the rearward end of said second portion, said second portion having a cutting edge and being parallel to, and spaced from, said first portion, said cutting edge being disposed below said handle, said first, second and third portions all having about the same width, and each blade being formed as a single piece.

2. The electric knife of claim 1, wherein said handle includes a top surface and a bottom surface, said top surface having an upwardly extending grip portion disposed near said handle forward end, and strap means attached to said bottom surface for securing the forearm of a user, and particularly a handicapped user, to said top surface rearwardly of said prip portion.

3. The electric knife of claim 2, wherein said handle top surface is configured to support a wrist, and said strap means secures said user's wrist to said support.

* * * * *